US005720067A

United States Patent [19]

Grearson

[11] Patent Number: 5,720,067

[45] Date of Patent: Feb. 24, 1998

[54] SYSTEM AND METHOD FOR INSTALLING DECK FRAMING

[75] Inventor: Kenneth R. Grearson, Park Ridge, Ill.

[73] Assignee: Multuloc International Systems Corporation, Park Ridge, Ill.

[21] Appl. No.: 600,377

[22] Filed: Feb. 12, 1996

[51] Int. Cl.[6] ..... E01D 21/00; E04B 1/16; E04G 17/18

[52] U.S. Cl. ..... 14/73; 249/23; 249/24; 249/211; 52/126.5; 52/126.7

[58] Field of Search ..... 14/73, 74.5, 77.1; 52/126.5, 126.7; 249/19, 23, 24, 25, 211

[56] References Cited

U.S. PATENT DOCUMENTS

| | | | |
|---|---|---|---|
| 2,985,937 | 5/1961 | Hillberg | 249/211 |
| 3,215,389 | 11/1965 | Williams | 249/19 X |
| 3,982,867 | 9/1976 | Pruett | 249/23 X |
| 3,989,219 | 11/1976 | Pruett | 249/211 X |
| 4,006,731 | 2/1977 | Carroll . | |
| 4,048,777 | 9/1977 | Carroll . | |
| 4,114,335 | 9/1978 | Carroll . | |
| 4,120,131 | 10/1978 | Carroll . | |
| 4,192,623 | 3/1980 | Borg | 52/126.5 X |
| 4,223,866 | 9/1980 | Black | 249/24 X |
| 4,274,239 | 6/1981 | Carroll . | |
| 4,349,491 | 9/1982 | Eyden | 249/19 X |
| 4,507,901 | 4/1985 | Carroll . | |
| 5,092,559 | 3/1992 | Tjelle | 249/211 |
| 5,359,826 | 11/1994 | Grearson . | |

OTHER PUBLICATIONS

United Steel Deck, Inc., Catalog, Deck Design Data Sheet No[4], Nicholas J. Bouras Inc., Summit, New Jersey, 1985.

TELESTRUT® Telescoping Strut, General Engineering Catalog, Catalog TLS-1, Unistrut Corporation, Wayne, Michigan (1993).

TELESTRUT® Telescoping Strut, Power to Build On Brochure, Unistrut Corporation, Wayne, Michigan (1992).

*Primary Examiner*—James Lisehora

*Attorney, Agent, or Firm*—Speckman, Pauley & Fejer

[57] ABSTRACT

A system and method for installing metal deck framing. One or more deck panels are secured with respect to and between two elongated structural framing members to form a deck panel structure. The deck panel structure is then positioned between two primary structural members in a position such that each structural framing member is suspended from a support arm or a support structure that is supported by a corresponding one of the primary structural members. At least each corner portion of the deck panel structure can be mechanically adjusted to vary a vertical position of the deck panel structure.

17 Claims, 3 Drawing Sheets

SYSTEM AND METHOD FOR INSTALLING DECK FRAMING

BACKGROUND OF THE INVENTION

1. Field of the Invention

This invention relates to a deck framing system and method for installing the system wherein prefabricated deck panel structures can be quickly positioned into place, for example between structural stringers of a bridge construction, and a vertical height of each deck panel structure can be quickly fine-tuned with easy mechanical adjustments.

2. Description of Prior Art

Many conventional deck structures are supported by an angle bracket which has one leg structurally welded to an edge portion or an underside of a horizontal flange of a steel stringer, a steel plate, a girder, or another suitable steel primary structural member. Deck pans or other suitable deck panels of conventional deck structures are individually positioned between opposing angle brackets which are welded into place in the field. Each deck pan is positioned upon horizontal flanges of such field-installed opposing angle brackets. The deck pan is then secured with a sheet metal screw or a weld, also at the jobsite.

With conventional deck framing systems, each vertical height adjustment to vary the elevation of the top of the deck pan requires labor-intensive field adjustments which are primarily accomplished with welded connections. Furthermore, many conventional deck framing systems have either welded connections or metal fasteners that are exposed beneath the deck structure. Such exposed welds and fasteners often require painting on the underside of the bridge or other deck structure, which also is a labor-intensive task.

There is an apparent need for a deck framing system that can be quickly erected, preferably using prefabricated deck panel structures which can be positioned directly upon horizontal flanges of steel stringers or other primary structural support members. There is also a need for a deck framing system wherein the vertical height of each deck panel structure can be quickly adjusted using simple mechanical elements rather than with secondary support brackets which are welded to the primary structural support members.

SUMMARY OF THE INVENTION

It is one object of this invention to provide a deck framing system which accommodates prefabricated deck panels that can be quickly positioned into place between two steel stringers or other primary structural support members.

It is another object of this invention to provide a deck framing system wherein the deck panels structures are directly supported on the steel stringer or other primary structural support member, without requiring structural welds between the horizontal flange of the steel stringer and any component of the deck panel structure.

It is another object of this invention to provide a simple mechanical mechanism for adjusting the vertical height of the deck panel structure without requiring field welds and additional secondary support brackets or other secondary structural members.

It is still another object of this invention to provide a deck framing system which relies primarily upon gravity forces to support and fix the position of the deck panel structure with respect to the steel stringer or other primary structural support member.

Deck framing systems can be used to construct bridges, for example. In many bridge constructions, parallel steel stringers are first erected, then the steel stringers are used to support deck framing systems which are often erected above an upper horizontal flange of the steel stringer. Because of the deflection of the steel stringer over a significant length of stringer nm, the vertical height of the deck panel structure often requires field adjustment. Although theoretical calculations can be used to derive the necessary adjustments and dimensions of secondary support brackets necessary for achieving proper vertical height, many bridge and other structural erections result in actual vertical heights that require field modifications which differ from the theoretical calculations. Thus, conventional methods and systems for compensating for such change in actual vertical height require labor-intensive field welding procedures and field-measured secondary structural members, such as brackets and the like. This invention significantly reduces the overall labor time necessary to install the deck framing system by employing prefabricated deck panels that include structural supports which can be quickly positioned upon and supported directly by the upper horizontal flange of the steel stringer. Furthermore, the deck framing system and method for installing the system, according to this invention, uses simple mechanical components to quickly adjust the height of any one or more of the four corner portions of the deck panel structure.

The above and other objects of this invention are accomplished with a deck framing system that has two elongated structural framing members of a deck panel structure which is preferably but not necessarily prefabricated. Each structural framing member preferably has a horizonal flange upon which an edge portion of the deck panel is positioned for support. Preferably at four positions of the panel, a support structure is attached to the deck panel structure. The support structure may include a support arm, a vertical position of which can be adjustably fixed with respect to the horizontal flange of the stringer.

In one preferred embodiment according to this invention, a threaded rod can be rotatably mounted with respect to the support arm. For example, the threaded rod can extend within a throughbore of the support arm. The threaded rod can engage threads of a nut which is fixed with respect to the structural framing member or which can be tightened to forcibly abut the structural framing member. By rotating the threaded rod, the structural framing member can move in the vertical direction.

When set in position, the deck panel structure is essentially supported by the four support structures that either rest directly upon or are supported by the steel stringer. After the vertical height of the deck panel structure is adjusted, an angle bracket, having one leg positioned between the horizontal flange of the steel stringer and the support structure and another leg positioned generally parallel to the vertical sidewall of the structural framing member, can be moved toward and then secured directly to the vertical sidewall. Such securement horizontally stabilizes the structural framing member with respect to the steel stringer.

Prefabricated deck panel structures, according to this invention, can be neatly stacked for space-efficient delivery. For example, multiple deck panel structures each having dimensions of approximately 8 feet by approximately 20 feet can be stacked in two piles on the bed of a typical delivery truck. At the jobsite, each pile of several deck panel structures can be quickly rigged so that a crane can lift the entire pile and place it on the bridge structure. Once on the bridge structure, a smaller crane can be used to lift and set each individual deck panel structure. By using prefabricated deck panel structures, according to this invention, field labor is not required to individually set each deck pan or other suitable deck panel.

BRIEF DESCRIPTION OF DRAWINGS

The above-mentioned and other features and objects of this invention will be better understood from the following detailed description taken in conjunction with the drawings wherein.

DESCRIPTION OF PREFERRED EMBODIMENTS

Figure 1:
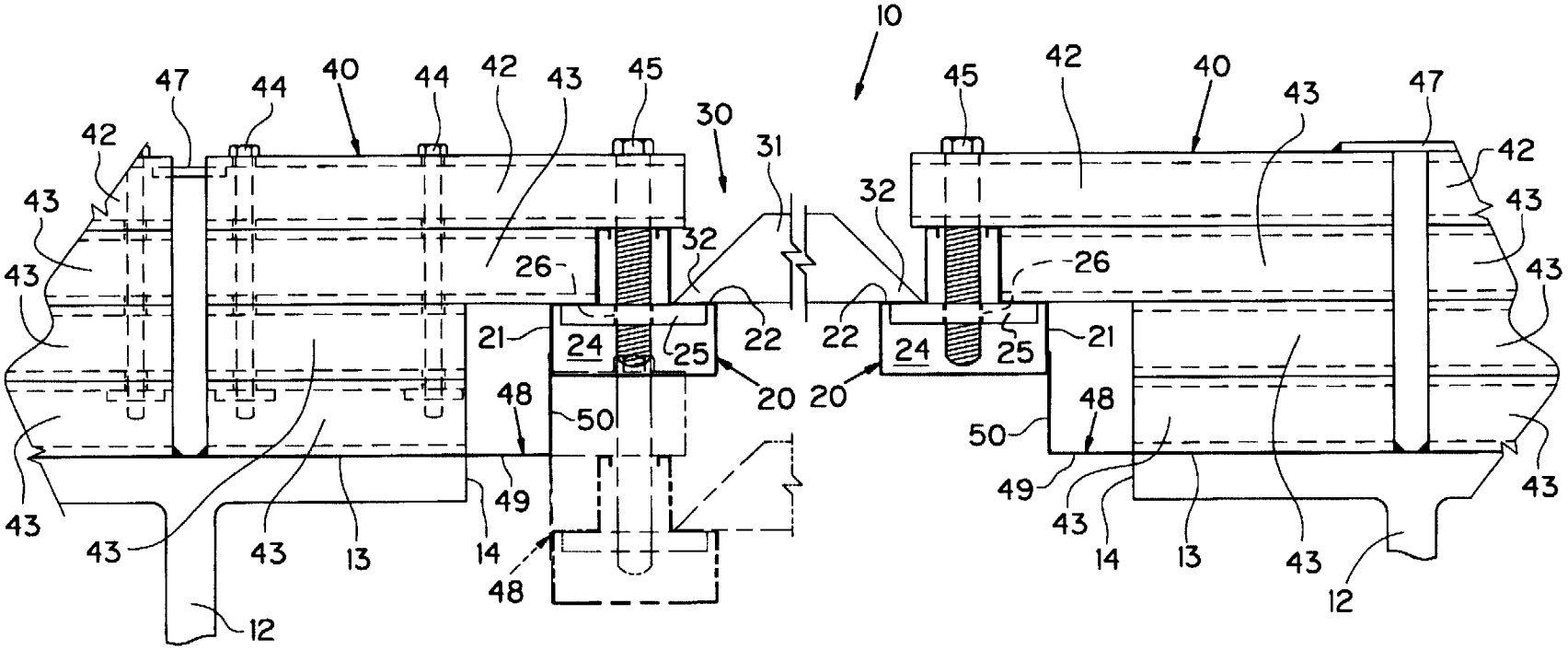
FIG. 1 is a partial from view of a deck framing system, according to one preferred embodiment of this invention.
Figure 2:
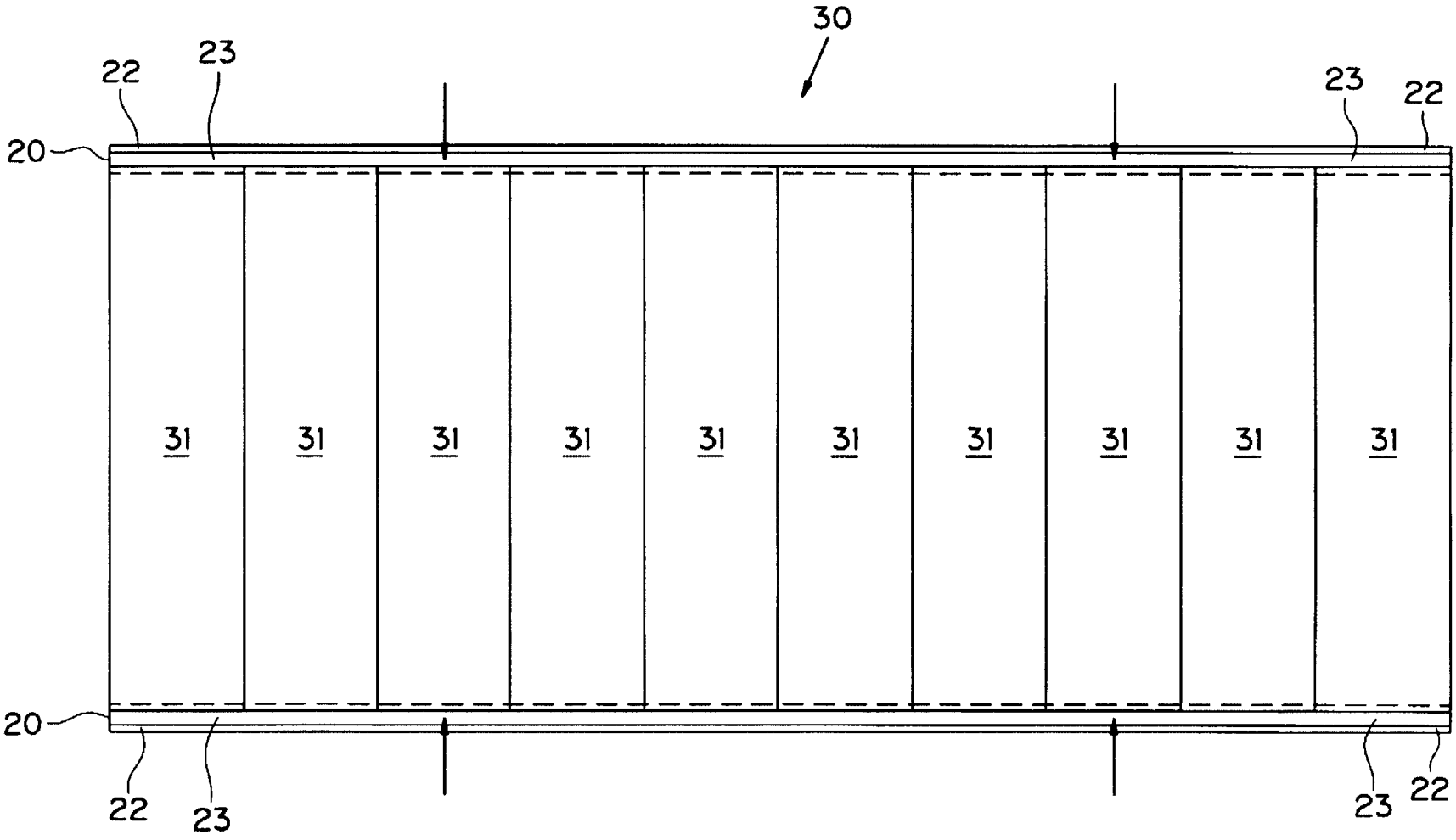
FIG. 2 is a plan schematic view of a deck panel structure, according to one preferred embodiment of this invention.

Although the components of deck framing system 10 according to this invention can be completely assembled in the field, a significant advantage is derived when deck panel structure 30 is prefabricated, for example in a shop environment, and then shipped to a jobsite for quick installation. FIG. 1 shows a partial front view of a typical installation according to deck framing system 10 of this invention. FIG. 2 shows a schematic top view of deck panel structure 30, according to one preferred embodiment of this invention. When prefabricated, deck panel structure 30 may comprise approximately ten deck panels 31, as shown, and may be sized about 8 feet wide by about 20 feet long, for example. It is apparent that depending upon the particular use and design, each deck panel structure 30 may comprise more or less than ten deck panels 31.

As best shown in FIGS. 1 and 2, deck panel structure 30 comprises one or more deck panels 31 positioned between and supported by two structural framing members 20 positioned on opposite sides of deck panel 31. In one preferred embodiment of this invention, deck panel 31 is positioned upon horizontal flange 22 of structural framing member 20. Deck panel 31 can be secured with respect to structural framing member 20 by a welded connection or by any other suitable mechanical connection means known to those skilled in the art, such as screw fasteners or the like. Any suitable means for supporting deck panel 31 with respect to structural framing member 20 can be used to secure edge portion 32 of deck panel 31 with respect to horizontal flange 22 or any other suitable structural component of structural framing member 20. Once prefabricated, deck panel structure 30 is relatively rigid and can be moved or shipped as an integral unit.

Deck framing system 10 according to this invention comprises means for mechanically adjusting and fixing a vertical position of and for supporting at least one end portion of structural framing member 20, with respect to structural member 12. Such mechanical adjustment means may comprise support arm 42, as clearly show in FIG. 1. Deck framing system 10 also comprises means for fixing a vertical position of support arm 42 with respect to horizontal support surface 13 of structural member 12. In one preferred embodiment according to this invention, such means comprise at least one spacing support member 43 positioned between support arm 42 and horizontal support surface 13.

Although three spacing support members 43 are shown in FIG. 1, it is apparent that more or less spacing support members 43 can be used to roughly accomplish a desired vertical height of deck panel 31. The dashed lines in FIG. 1 show the position of deck panel 31 with only one support arm 42 and no spacing support members 43. Once the desired height is roughly achieved, the mechanical adjustment means can be used to fine-tune the vertical height to achieve an exact dimension. As shown in FIG. 1, threaded bolt 44 is used to secure support arm 42 with respect to spacing support member 43. It is apparent that other suitable connectors can be used to secure support arm 42 with respect to each spacing support member 43. Support arm 42 and spacing support member 43 may comprise square tubing, U-shaped channel structures, particularly those manufactured by Unistrut Corporation, in Wayne, Mich., or any other suitable structural member that is relatively strong and relatively lightweight.

By using threaded bolt 44 to secure support arm 42 with respect to each spacing support member 43, it is relatively quick and easy to add or eliminate in the field, as necessary, one or more spacing support members 43. As shown in FIG. 1 threaded bolt 44 mates with nut 46. Nut 46 can be a square nut with dimensions which prevent it from completely rotating within spacing support member 43. Such square nuts or other suitable connectors are well known to those skilled in the art of structural framing members. It is also possible to weld support arm 42 with respect to one or more spacing support members 43. However, such welded connections require additional labor to accommodate more field modifications.

Support structures 40 are preferably prefabricated and attached with respect to structural framing members 20, prior to lowering deck panel structure 30 into position upon horizontal support surface 13 of structural member 12. In one preferred embodiment according to this invention, threaded rod 45 is rotatably mounted with respect to support arm 42. As shown in FIG. 1, threaded rod 45 passes through upper and lower throughbores within support arm 42. In such position, threaded rod 45 can be rotated about its longitudinal axis.

Threaded rod 45 is preferably externally threaded and mates within threaded bore 26 of nut 25. It is apparent that threaded rod 45 could be internally threaded and mate with an externally threaded rod secured with respect to structural framing member 20. However, the externally threaded embodiment of threaded rod 45 is more practical and requires fewer speciality parts.

Nut 25 can either be secured with respect to structural framing member 20, for example by welding, or can have dimensions which prevent nut 25 from completely rotating about a longitudinal axis of threaded bore 26, within hollow space 24 defined by structural framing member 20. Like nut 46, suitable designs for nut 25 are also well known to those skilled in the art of structural framing members.

Figure 4:
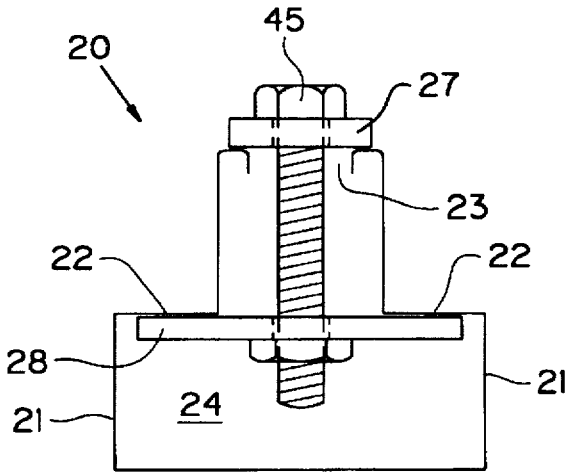
FIG. 4 is a schematic front view showing the butt connection of FIG. 3.
Figure 3:
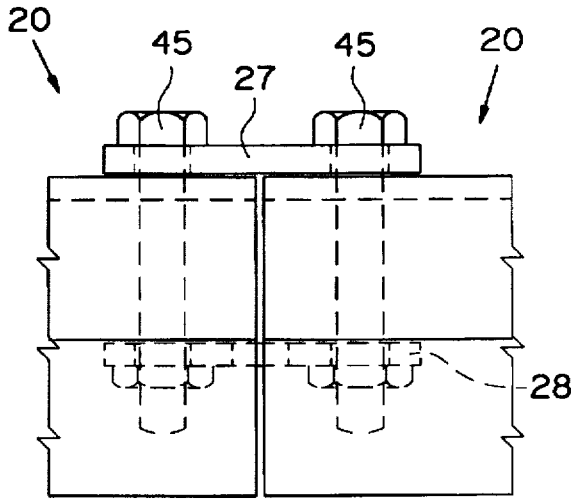
FIG. 3 is a schematic side view showing a butt connection between two structural framing members, according to one preferred embodiment of this invention.
Figure 5:
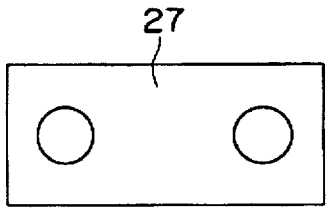
FIG. 5 is a top view of a splice plate, as shown in FIG. 3.
Figure 6:
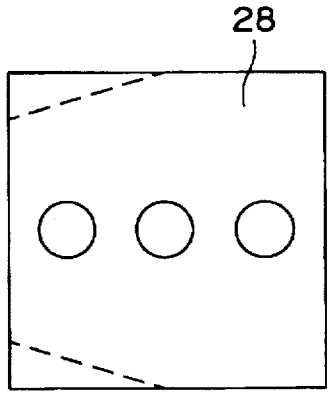
FIG. 6 is a top view of a splice plate, as shown in FIG. 3.

Structural framing member 20 is a known structural shape that is described in U.S. Pat. No. 5,359,826, the entire teachings of which are incorporated into this specification by reference to U.S. Pat. No. 5,359,826. FIG. 4 of U.S. Pat. No. 5,359,826 shows a butt end connection that can be used between structural framing members 20 according to this invention. A similar connection arrangement is shown in FIGS. 3–6, corresponding to this specification. As shown in FIGS. 3–5, splice plate 27 can be used on the top portion of structural framing member 20. As shown in FIGS. 3, 4 and 6, splice plate 28 can be positioned in the larger hollow space 24. Splice plate 28 can also have corner portions cut away, as shown by the dashed lines in FIG. 6, for assisting with longitudinal alignment of one structural framing member 20 with respect to another structural framing member 20.

Referring to FIG. 1, as threaded rod 45 is rotated and engages nut 25, structural framing member 20 and thus deck panel structure 30 moves in a vertical direction. Thus, with simple mechanical elements such as threaded rod 45 and nut 25, each structural framing member 20 can be vertically adjusted to a desired position. Bridge constructions, for example, often require the top surface of deck panel 31 to be at a certain elevation. By positioning four support structures 40 m general areas as shown by the four arrows in FIG. 2, each corner portion of deck panel structure 30 can be individually adjusted to properly and precisely position deck panel structure 30, for example to accommodate for tolerance variations and inaccuracies associated with manufacture and/or deflection of structural member 12.

Structural framing member 20, as shown in FIG. 1, is preferred because such suitably shaped structural member has horizontal flanges 22, as clearly shown in FIG. 4, upon which edge portions 32 of deck panel 31 can be conveniently positioned. It is apparent that other suitably shaped structural members, such as those shown and described in U.S. Pat. No. 5,359,826, can be used in place of or in combination with structural framing members 20 as shown in FIG. 1.

Structural framing member 20, as shown m FIGS. 1 and 4, also offers opening 23, which is preferably a channel opening for accommodating various positions of threaded rod 45 along the length of structural framing member 20. It is also apparent that structural framing member 20 may comprise a tubular structural member, such as square tubing. With such structural member, opening 23 could be a slot or a throughbore which extends through at least one wall of the tubing.

Prior to lowering deck panel structure 30 and support structures 40 onto horizontal support surface 13 of structural member 12, angle bracket 48 can be positioned so that leg 49 contacts horizontal support surface 13. Angle bracket 48 may or may not be tack welded to structural member 12 to temporarily hold angle bracket 48 in place. Once deck panel structure 30 and support structures 40 are lowered onto leg 49 of angle bracket 48, angle bracket 48 can be slid in a direction toward the corresponding structural framing member 20, for example far enough to allow leg 50 of angle bracket 48 to abut sidewall 21 of structural framing member 20. Once angle bracket 48 is moved into position leg 48 can be secured, with a welded or other suitable mechanical connection, directly to or with respect to sidewall 21. Such arrangement horizontally stabilizes structural framing member 20 and thus deck panel structure 30. If desired, once angle bracket 48 is in final position, leg 49 can be welded directly to structural member 12. The weight of deck panel structure 30 and support structures 40 positioned upon leg 49 of angle bracket 48 can be sufficient for maintaining the position of deck panel structure 30 with respect to structural member 12. Angle bracket 48 can extend for either a portion or substantially the entire length of each structural framing member 20. As shown in FIG. 1, if desired, bracket 47 can be secured to adjacent support structures 40 to provide additional stability.

In one preferred embodiment according to this invention, a method for installing deck framing system 10 includes erecting deck panel structure 30 by attaching at least one deck panel 31 between two structural framing members 20 and attaching two or more support structures 40 to each structural framing member 20. Deck panel structure 30 is then preferably transported and installed as a prefabricated structure. Deck panel structure 30 is positioned between two structural members 12, wherein a distance between innermost edges 14 of horizontal support surfaces 13 is greater than a width at outermost edges of deck panel structure 30. Threaded rod 45 or other suitable mechanical adjustment means are then used to mechanically adjust a vertical position of at least one end portion of structural framing member 20, with respect to support arm 42 and thus structural member 12.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A metal deck framing system supported from a structural member having a horizontal support surface, the deck framing system comprising:

two elongated structural framing members, a deck panel, first means for supporting said deck panel with respect to said structural framing members; and second means for mechanically adjusting and fixing a vertical position of and supporting at least one of said structural framing members with respect to the structural member, said second means comprising a support arm, third means for fixing a vertical position of said support arm with respect to the horizontal support surface of the structural member, a threaded rod rotatably mounted with respect to said support arm, and fourth means for engaging external threads of said rod upon rotation of said rod and thereby vertically adjusting said structural framing member with respect to said structural member.

2. A metal deck framing system according to claim 1 wherein said first means comprise each of said structural framing members having a horizontal flange.

3. A metal deck framing system according to claim 2 wherein said first means further comprise an edge portion of said deck panel positioned upon said horizontal flange.

4. A metal deck framing system according to claim 1 wherein said third means comprise at least one spacing support member positioned between said support arm and the horizontal support surface.

5. A metal deck framing system according to claim 4 wherein said support arm and said at least one spacing support member are secured with respect to each other.

6. A metal deck framing system according to claim 1 wherein said fourth means comprise a nut having a threaded bore, said threaded rod engageably mated within said threaded bore, and fifth means for preventing complete rotational movement about a longitudinal axis of said threaded bore of said nut with respect to said structural framing member.

7. A metal deck framing system according to claim 6 wherein said structural framing member has an opening through which said threaded rod extends.

8. A metal deck framing system according to claim 6 wherein said fifth means comprise said structural framing member having a hollow space, said nut mounted within said hollow space and a dimension of said nut sized to interfere with a distance between inner sidewalls of said structural framing member.

9. A metal deck framing system according to claim 8 further comprising sixth means for horizontally stabilizing at least one of said structural framing members.

10. A metal deck framing system according to claim 9 wherein said sixth means comprise an angle bracket having one leg contacting the horizontal support surface of the structural member and another leg positioned generally parallel to a vertical sidewall of at least one of said structural framing members.

11. A metal deck framing system according to claim 1 wherein said fourth means comprise an upper portion of said structural framing member having an opening, and said rod extending through said opening.

12. A method for installing a metal deck framing system, including the steps of:

erecting a deck panel by attaching at least one deck pan between two structural framing members;

attaching two support structures to each structural framing member;

positioning the deck panel between two structural members each having a horizontal support surface, a distance between innermost edges of said horizontal support surfaces being greater than a width of the deck panel at outermost edges of the deck panel, with the two support structures attached to each of the structural members supported by the corresponding horizontal support surface; and mechanically adjusting a vertical position of at least one of the structural framing members with respect to at least one of the structural members.

13. A method according to claim 12 further comprising positioning an angle bracket with one leg of the angle bracket generally parallel to a sidewall of one of the structural framing members and another leg of the angle bracket between the corresponding horizontal support surface and one of the structures.

14. A method according to claim 13 wherein the angle bracket is moved toward the sidewall until the one leg contacts the sidewall.

15. A method according to claim 14 wherein the one leg is secured with respect to the sidewall to fix the vertical position of the corresponding structural framing member.

16. A method according to claim 12 wherein the vertical position is adjusted by rotating a threaded rod that is rotatably mounted with respect to the corresponding support arm and that is mateably engaged within a threaded nut that is fixed with respect to the corresponding structural framing member.

17. A method according to claim 12 wherein a distance is maintained between two of the support structures adjacently positioned one of the structural members.

* * * * *